US007008126B2

(12) United States Patent
Kawaguchi

(10) Patent No.: US 7,008,126 B2
(45) Date of Patent: Mar. 7, 2006

(54) WIRE DOT PRINTER HEAD AND WIRE DOT PRINTER

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/655,894

(22) Filed: Sep. 4, 2003

(65) Prior Publication Data

US 2005/0053407 A1 Mar. 10, 2005

(51) Int. Cl.
*B41J 2/275* (2006.01)

(52) U.S. Cl. ..... 400/124.23; 400/124.17

(58) Field of Classification Search ..... 400/124.23, 400/124.11, 124.14, 124.17
See application file for complete search history.

(56) References Cited

U.S. PATENT DOCUMENTS

| | | | | |
|---|---|---|---|---|
| 4,537,520 | A | | 8/1985 | Ochiai et al. |
| 4,552,064 | A | * | 11/1985 | Sanders et al. ..... 101/93.05 |
| 4,674,896 | A | | 6/1987 | Yasunaga et al. |
| 4,697,393 | A | | 10/1987 | Madray |
| 4,767,227 | A | | 8/1988 | Mitsuishi et al. |
| 4,881,832 | A | | 11/1989 | Mitsuishi et al. |
| 4,988,223 | A | | 1/1991 | Hilkenmeier et al. |
| 4,993,854 | A | | 2/1991 | Sato |
| 5,074,687 | A | | 12/1991 | Gugel et al. |
| 5,137,377 | A | | 8/1992 | Ito et al. |
| 5,205,659 | A | | 4/1993 | Gugel et al. |
| 5,290,112 | A | | 3/1994 | Stempfle et al. |
| 6,513,997 | B1 | | 2/2003 | Terao |
| 6,698,956 | B1 | | 3/2004 | Terao et al. |
| 6,776,545 | B1 | | 8/2004 | Terao |
| 6,805,503 | B1 | | 10/2004 | Tsuchiya et al. |
| 6,848,843 | B1 | | 2/2005 | Kawaguchi |
| 2004/0170461 | A1 | | 9/2004 | Kawaguchi |

FOREIGN PATENT DOCUMENTS

| | | | | |
|---|---|---|---|---|
| JP | 02-011336 | A | | 1/1990 |
| JP | 7-22994 | B2 | | 2/1990 |
| JP | 3-7351 | A | | 1/1991 |
| JP | 03039256 | A | * | 2/1991 |
| JP | 03-191036 | A | | 8/1991 |
| JP | 03288660 | A | * | 12/1991 |
| JP | 4-002639 | A | | 1/1992 |
| JP | 4-31061 | A | | 2/1992 |
| JP | 04-105945 | A | | 4/1992 |
| JP | 5-35288 | U | | 5/1993 |
| JP | 6-218954 | A | | 8/1994 |
| JP | 06227000 | A | * | 8/1994 |
| JP | 07-125265 | A | | 5/1995 |

(Continued)

OTHER PUBLICATIONS

Machine translation of JP 6-227000 to Ito et al. from Japanese Patent Office website.*

(Continued)

*Primary Examiner*—Daniel J. Colilla
(74) *Attorney, Agent, or Firm*—Frishauf, Holtz, Goodman & Chick, P.C.

(57) ABSTRACT

In the wire dot printer head and wire dot printer of the present invention, a plurality of armatures are rockably mounted in positions corresponding to a plurality of cores. On the end face on the core side of a wire, a plurality of receiving members are provided. And a plurality of pressing members for pressing the armature to move away from the core are mounted in contact with these receiving members. The receiving member therefore can prevent the pressing member from damaging to break the armature.

16 Claims, 9 Drawing Sheets

FOREIGN PATENT DOCUMENTS

| | | | | |
|---|---|---|---|---|
| JP | 09-187972 | A | | 7/1997 |
| JP | 09-314868 | A | | 12/1997 |
| JP | 10-006537 | A | | 1/1998 |
| JP | 2833001 | B2 | | 10/1998 |
| JP | 10-291330 | A | | 11/1998 |
| JP | 2850673 | B2 | | 11/1998 |
| JP | 11078075 | A | * | 3/1999 |
| JP | 2944562 | B2 | | 6/1999 |
| JP | 11291524 | A | * | 10/1999 |
| JP | 2000-280497 | A | | 10/2000 |
| JP | 2001-219586 | A | | 8/2001 |

OTHER PUBLICATIONS

U.S. Appl. No. 10/655,281, filed Sep. 3, 2003, Kawaguchi.
U.S. Appl. No. 10/764,642, filed Jan. 26, 2004, Kawaguchi.
U.S. Appl. No. 10/940,361, filed Sep. 14, 2004, Kawaguchi et al.
U.S. Appl. No. 10/940,362, filed Sep. 14, 2004, Kawaguchi et al.
U.S. Appl. No. 10/940,492, filed Sep. 14, 2004, Tsuchiya et al.
U.S. Appl. No. 10/940,432, filed Sep. 14, 2004, Kawaguchi.
U.S. Appl. No. 10/940,338, filed Sep. 14, 2004, Kawaguchi et al.
U.S. Appl. No. 11/073,118, filed Mar. 3, 2005, Kawaguchi et al.
U.S. Appl. No. 11/073,117, filed Mar. 3, 2005, Tsuchiya et al.
U.S. Appl. No. 11/073,092, filed Mar. 3, 2005, Kawaguchi et al.
U.S. Appl. No. 11/073,093, filed Mar. 3, 2005, Kawaguchi et al.

* cited by examiner

WIRE DOT PRINTER HEAD AND WIRE DOT PRINTER

BACKGROUND OF THE INVENTION

1. Field of the Invention

The present invention relates to a wire dot printer head and a wire dot printer.

2. Discussion of the Background

A wire dot printer head is an apparatus which performs printing by rocking, between a waiting position and a printing position, an armature with a printing wire connected thereto, to strike the front end of the wire on a printing medium such as a sheet when the armature is rocked to the printing position.

As the wire dot printer head, there has been developed an apparatus for printing by the use of a magnetic circuit which attracts an armature from a waiting position to a printing position with a magnetic flux generated by a coil around the armature to be rocked.

In such a wire dot printer head, the armature has an arm which supports a wire for printing. The wire for printing is supported in such a manner that the armature is rotatable on the center of a support shaft in a direction in which the armature moves away from a core wound with a coil. The armature is being pressed by a pressing member such as a coil spring in a direction in which it moves away from the core. (Refer to Japanese Patent Laid-Open No. Hei 10-291330 and Japanese Patent No. 2833001.) In this case, the pressing member is located in a position in which it comes in contact with the arm of the armature. Thus, the pressing member is in constant contact with the arm of the armature.

With a recent trend toward faster printing operation, however, the armature rocks between the printing position and the waiting position at such a high speed as 2500 times per second. Therefore, the contact area of the arm which is in contact with the pressing member is subject to gradual abrasion by the pressing member, with the result that the armature will finally be broken at the contact area. Furthermore, to realize the further speedups of printing operation, armature weight reduction is demanded. The armature arm is formed as thin as possible, about 0.20 mm for example, for the purpose of decreasing the moment of inertia caused by the rocking of the armature. The armature arm, therefore, is an easy-to-break structure. Here, in the case that the arm is formed of, for example, a heat-treated 0.20 mm-thick SK-5 plate, the contact area of the arm which is in contact with the pressing member has as low durability as only about 30 k dots. With this durability, the armature is liable to failures at an early time, and consequently a shortened life of the wire dot printer head will result.

SUMMARY OF THE INVENTION

It is therefore an object of the present invention to provide a wire dot printer head and a wire dot printer in which an armature is protected from fracture by preventing a pressing member from giving damage to the armature.

The object of the present invention is accomplished by novel wire dot printer head and wire dot printer of the present invention.

According to the new wire dot printer head and wire dot printer of the present invention, therefore, a plurality of armatures are rockably mounted in opposite positions of a plurality of cores. The armatures are provided with a plurality of receiving members on the end face on the core side of their arms. A plurality of pressing members are mounted in contact with these receiving members. The armatures are being pressed by the pressing members toward moving away from the cores, so that the armatures will not be damaged by the pressing members.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Wire dot printer head and wire dot printer according to one embodiment of the present invention will be explained by referring to FIGS. 1 to 9.

Figure 1:
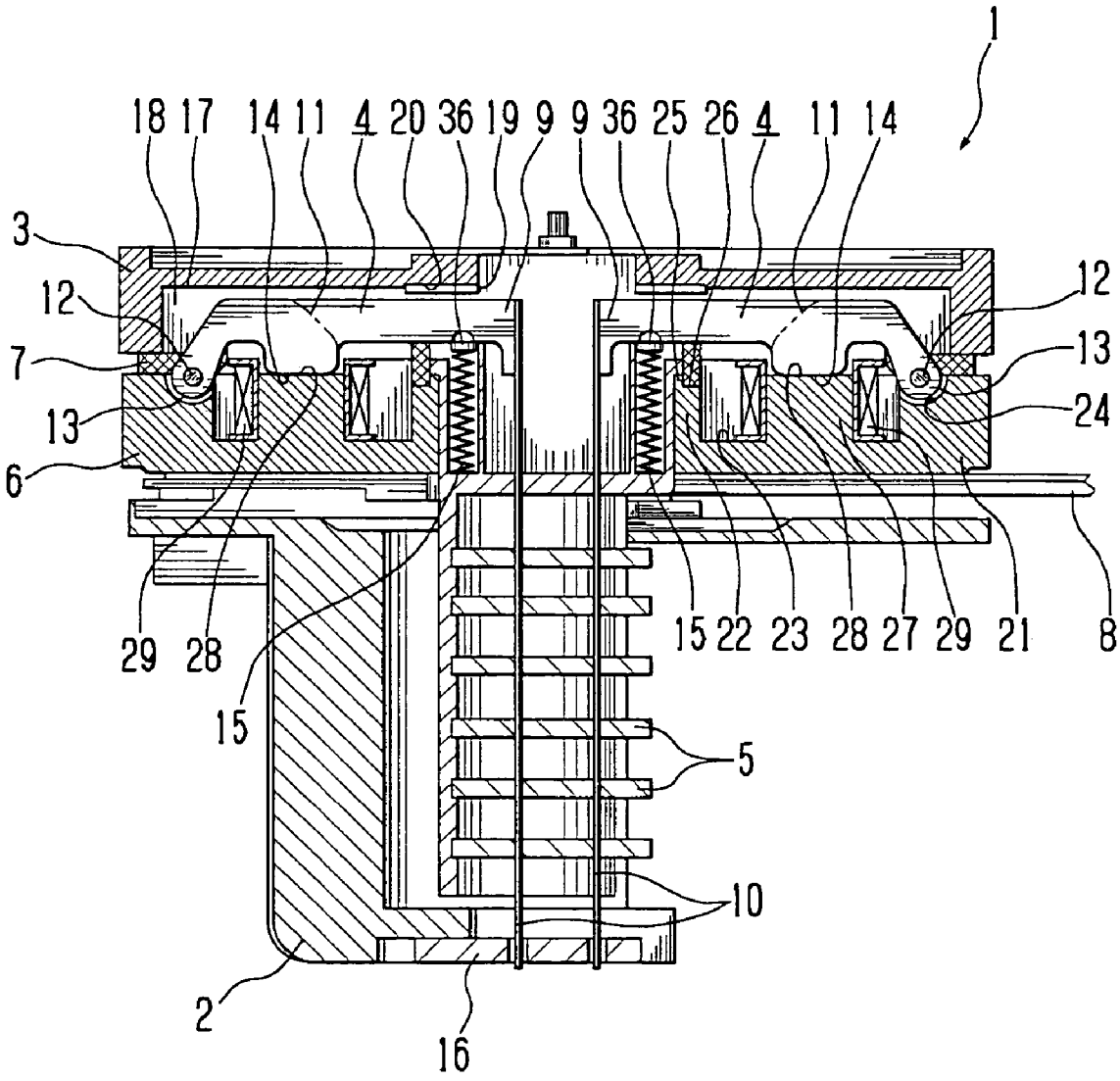
FIG. 1 is a central longitudinal sectional front view schematically showing a wire dot printer head according to embodiments of the present invention.
Figure 2:
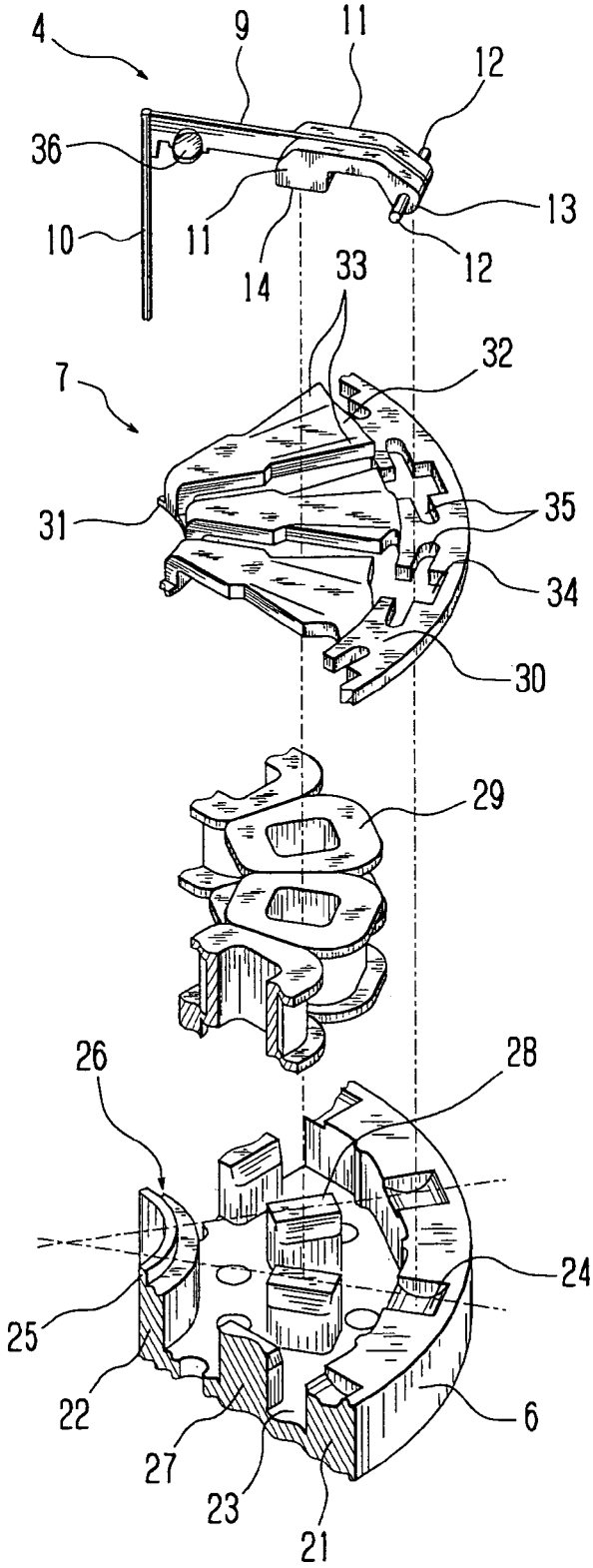
FIG. 2 is an exploded perspective view schematically showing a part of the wire dot printer head according to the embodiments of the present invention.

First, the general configuration of the wire dot printer head will be explained by referring to FIGS. 1 to 4. FIG. 1 is a central longitudinal sectional front view schematically showing the wire dot printer head. FIG. 2 is an exploded perspective view schematically showing a part of the wire dot printer head.

A wire dot printer head 1 is provided with a front case 2 and a rear case 3, which are connected by mounting screws (not shown). Between these cases, an armature 4, a wire guide 5, a yoke 6, an armature spacer 7, and a circuit board 8 are installed.

The armature 4 has an arm 9 formed in a shape of plate, a printing wire (hereinafter referred to just as the wire) 10 brazed to one end side in the direction of length of the arm 9 (in a direction in which the arm is extended), a magnetic circuit forming member 11 welded on both sides in the direction of width of the arm 9, and a support shaft 12. On the other end side of the armature 4 is formed a circular portion 13. The magnetic circuit forming member 11 has a surface to be attracted 14, which is located at the central part, in the longitudinal direction, of the armature 4.

The armature 4 is radially disposed in a plurality of positions in relation to the axial center of the yoke 6. The armature 4 is supported on the surface of the yoke 6, being rotatable on the center of the support shaft 12 in a direction in which the armature 4 moves away from the yoke 6. That is, the armature 4 is being pressed by a pressing member 15, such as a coil spring, in a direction in which the armature 4 moves away from the yoke 6. The pressing member 15 is so retained as is capable of pressing operation. When the armature 4 rocks to the printing position, the front end of the wire 10 moves to a predetermined position, for instance to a position where the front end hits on a printing medium such as sheet.

The wire guide 5 guides the wire 10 slidably so that the front end of the wire 10 will hit on the predetermined position of the printing medium. The front case 2 is provided with a front end guide 16 for aligning the front end of the wire 10 in a predetermined pattern and also for slidably guiding the wire 10.

In the rear case 3, a cylindrical portion 18 having a bottom section 17 on one end side is located. At the central part of the bottom section 17 is formed a mounting recess 20 in which an annular metallic armature stopper 19 is mounted. The armature stopper 19 is mounted by being fitted in the mounting recess 20.

Here, when the armature 4 is rocked by the pressing member 15 away from the printing position, the arm 9 which is a part of the armature 4 comes in contact with the armature stopper 19, to thereby stop the rocking motion of the armature 4. Therefore, the armature stopper 19 has a function to determine the waiting position of the armature 4.

The circuit board 8 has a circuit for controlling the rocking motion of the armature 4 between the printing position and the waiting position. In printing, it is possible to selectively rock an arbitrary armature 4 through the control of the circuit board 8.

The yoke 6 is formed of a magnetic material, having a pair of concentrically formed cylindrical portions 21 and 22 of different diameters. The cylindrical portions 21 and 22 have mutually the same dimensions in the axial direction (in the vertical direction in FIG. 1, which will hereinafter be called the axial direction of the yoke 6). The cylindrical portion 21 on the outer periphery side and the cylindrical portion 22 on the inner periphery side are unitarily formed by a bottom section 23 which is so formed as to close the one-end side in the axial direction.

The cylindrical portion 21 on the outer periphery side is provided with a plurality of recesses 24. The inner periphery of these recesses 24 has a concavity formed to approximately the same curvature as the curvature of the outer periphery of the circular portion 13 of the armature 4. There are provided the same number of the recesses 24 as the armatures 4. In each of the recesses 24, the circular portion 13 is slidably fitted on one-end side of the armature 4.

On the cylindrical portion 22 on the inner periphery side, an annular portion to be fitted 25 is formed. The portion to be fitted 25 is formed unitarily with the cylindrical portion 22 on the inner periphery side so as to be concentrically positioned in relation to the cylindrical portion 22 on the inner periphery side. The outside diameter of the portion to be fitted 25 is set smaller than the outside diameter of the cylindrical portion 22 on the inner periphery side. Therefore, on the cylindrical portion 22 on the inner periphery side, a stepped portion. 26 is formed by the portion to be fitted 25.

The bottom section 23 has a plurality of cores 27 which are formed unitarily in an annular shape between the cylindrical portion 21 on the outer periphery side and the cylindrical portion 22 on the inner periphery side. Each core 27 in the axial direction of the yoke 6 has the same dimensions as the cylindrical portions 21 and 22 in the axial direction of the yoke 6.

On one end in the axial direction of the yoke 6 of each core 27, a pole face 28 is formed. The pole face 28 of the core 27 is provided in such a manner that it will face the face to be attracted 14 of the magnetic circuit forming member 11 of the armature 4. Furthermore, on the outer periphery of each core 27, a coil 29 is wound. That is, the yoke 6 has the cores 27 each wound in an annular form with the coil 29.

The yoke 6 is sandwiched between the front case 2 and the rear case 3 in such a manner that its open side opposite to the bottom section 23 will face to the other open end side of the rear case 3. It should be noted that, in the present embodiment, the direction of winding of all coils 29 is set equal, but is not limited thereto; that is, coils wound in different directions maybe selectively positioned.

The armature spacer 7 has a pair of ring-shaped portions 30 and 31 having approximately the same diameter as the cylindrical portions 21 and 22 of the yoke 6, and a plurality of guide portions 32 radially mounted across the pair of ring-shaped portions 30 and 31 so as to be located between the armatures 4. The ring-shaped portion 30 on the outer periphery side and the ring-shaped portion 31 on the inner periphery side are mounted concentrically. The ring-shaped portion 30 on the outer periphery side, the ring-shaped portion 31 on the inner periphery side, and the guide portion 32 are integrally formed.

With the armature spacer 7 placed on the yoke 6, the ring-shaped portion 30 on the outer periphery side and the ring-shaped portion 31 on the inner periphery side comes in contact with the cylindrical portions 21 and 22 of the yoke 6. The ring-shaped portion 31 on the inner periphery side, in this position, engages with the portion to be fitted 25. The inside diameter of the ring-shaped portion 31 on the inner periphery side is set equal to, or slightly larger than, the outside diameter of the portion to be fitted 25.

Each guide portion 32 has a side yoke portion 33, which is extended in a slanting direction, that is, in a direction in which the guide portion 32 will go away from the pole face 28 of the core 27 along nearly a radial direction of the ring-shaped portions 30 and 31. The side yoke portion 33 is formed in the shape of a sector which becomes wider as it approaches the ring-shaped portion 30 on the outer periphery side from the ring-shaped portion 31 on the inner periphery side.

In the armature spacer 7, a plurality of guide portions 32 are mounted across a pair of ring-shaped portions 30 and 31. There are therefore formed slit-like guide grooves 34 which open along the radial direction of the ring-shaped portions 30 and 31. Each of the guide grooves 34 is formed to the width that each guide portion 32 will approach the magnetic circuit forming member 11 to such a degree that the rocking motion of the armature 4 will not be interfered with.

The guide groove 34 communicates with the ring-shaped portion.30 on the outer periphery side. In the guide groove 34 at the ring-shaped portion 30 on the outer periphery side, a bearing groove 35 which is a cutout section is formed, continuously open to the guide groove 34, on both sides of the guide groove 34 along the direction of the outside diameter of the ring-shaped portion 30. In the bearing groove 35, the support shaft 12 of the armature 4 is fitted. That is, the support shaft 12 of the armature 4 is held by the yoke 6 and the armature spacer 7 in such a manner that a plurality of armatures 4 may respectively face to the cores 27.

On the armature spacer 7, a holding member (not shown) is placed to hold the support shafts 12 of a plurality of armatures 4. The holding member is a member for holding the support shafts 12 of a plurality of armatures 4 by connecting the front case 2 and the rear case 3 by mounting screws. The holding member is formed annular, and, furthermore, is so formed that the rocking motion of the armature 4 will not be interfered with.

Figure 3:
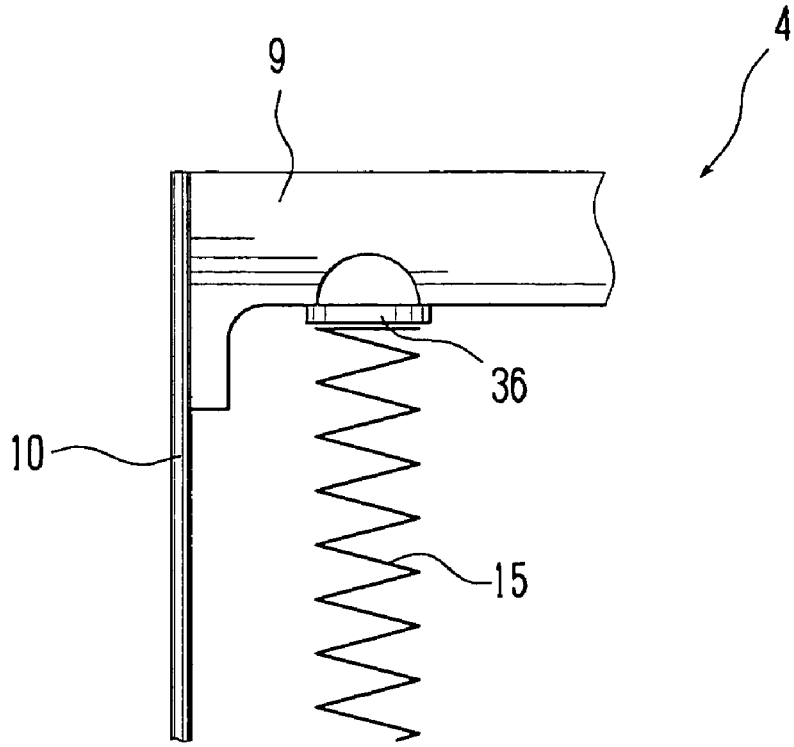
FIG. 3 is a side view schematically showing a part of an armature of the wire dot printer head according to the embodiments of the present invention.
Figure 4:
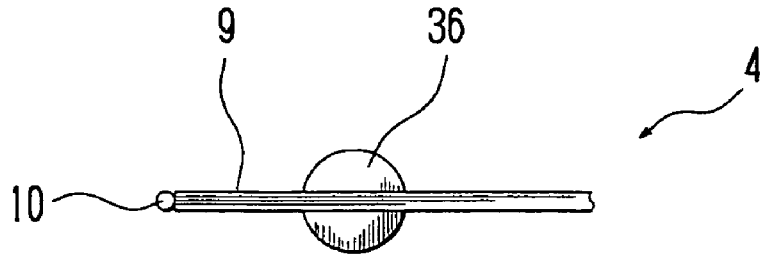
FIG. 4 is a plan view schematically showing a part of the armature of the wire dot printer head according to the embodiments of the present invention.
Figure 5:
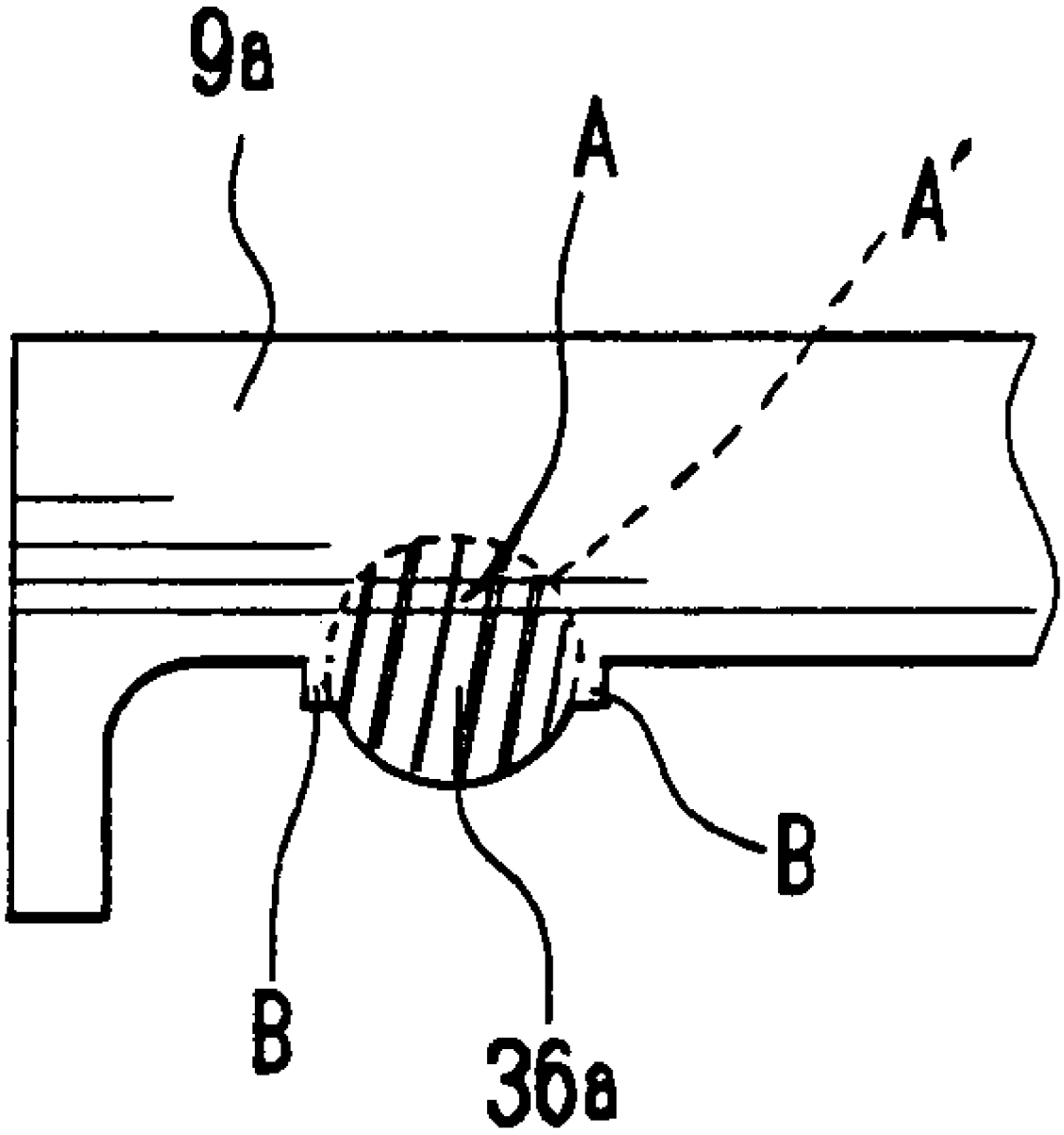
FIG. 5 is a side view for explaining a method of forming a part of the armature of the wire dot printer head according to the embodiments of the present invention.

Here, the structure of a part of the armature 4 will be explained with reference to FIGS. 3 and. 4. FIG. 3 is a schematic side view showing a part of the armature 4. FIG. 4 is a schematic plan view showing a part of the armature 4. And FIG. 5 is a side view for explaining the method of forming a part of the armature 4.

A plurality of armatures 4 are provided with a plurality of receiving members 36 disposed on the end face on the core 27 side of each arm 9. The pressing member 15 has a contact face 37 for being in contact with the receiving member 36. The contact face 37 is disposed in a position in which it comes in contact with the receiving member 36, so that the contact face 37 may be in constant contact with the receiving member 36.

The receiving member 36 is formed in the shape of plate, unitarily with the arm 9 of the armature 4. The receiving member 36 is formed unitarily with the arm 9 by bending a part 36*a* of the plate 9*a* for forming the arm 9 (see FIG. 5) . To describe in detail, the part A indicated by a dashed line A' in the plate 9*a* for forming the arm 9 is cut off. The arm 9 of the armature 4 and the receiving member 36 are unitarily formed by turning, on the axis of the supporting point B, the part 36*a* of the plate 9*a* which will become the receiving member 36. Furthermore, the receiving member 36 is so bent as to be orthogonal to the direction of pressure applied by the pressing member 15.

In the present embodiment, the arm 9 of the armature 4 and the receiving member 36 are produced of for example a heat-treated 0.20 mm-thick SK-5 plate. The arm 9 of the armature 4 has been set considerably smaller in width (a diameter in the case the pressing member 15 is a coil spring for example) than the pressing member 15. That is, the end face on the core 27 side of the arm 9 is formed such that the width in a direction orthogonal to the direction of extension of the arm 9 will become less than that of the pressing member 15 in the direction of width. The pressing member 15 is formed to the smallest possible size at which a pressure needed for high-speed printing is obtainable.

Figure 6:
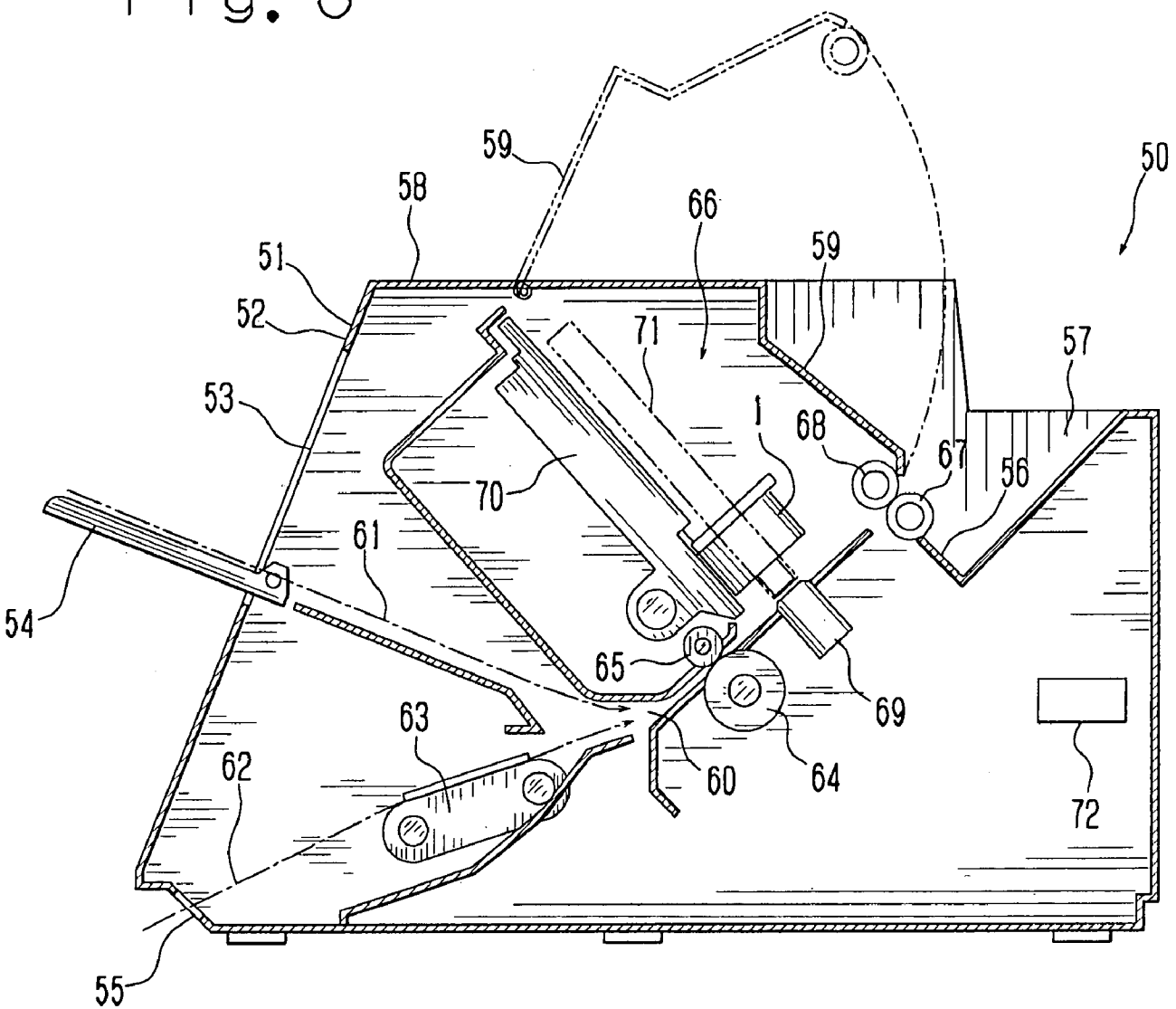
FIG. 6 is a longitudinal sectional side view schematically showing a wire dot printer according to the embodiments of the present invention.

Next, a wire dot printer 50 provided with the wire dot printer head 1 described above will be explained by referring to FIG. 6. FIG. 6 is a longitudinal sectional side view schematically showing the wire dot printer 50.

The wire dot printer 50 has a body case 51. At the front 52 of the body case 51, an opening 53 is formed. At the opening 53, a manual feed tray 54 is openably installed. Furthermore, at the lower part on the front 52 side of the body case 51, a paper feed port 55 is formed, while on the back side 56 a printed sheet receiver 57 is installed. Furthermore, at the top 58 of the body case 51, an opening-closing cover 59 is rotatably mounted. The opening-closing cover 59 in its opened position is indicated by an imaginary line in FIG. 1.

In the body case 51, there is provided a sheet conveying route 60 which is a printing medium conveying route. The sheet conveying route 60 is connected, on the upstream side in the sheet conveying direction, to a sheet feed passage 61 located on the extension surface of the manual feed tray 54 in the open position and to a sheet feed passage 62 communicating with the paper feed port 55, and, on the downstream side in the sheet conveying direction, to the printed sheet receiver 57. In the sheet feed passage 62, a tractor 63 for carrying the sheet is provided.

In the sheet conveying route 60, a conveyor roller 64 and a press roller 65 are oppositely arranged; the press roller 65 being pressed to the conveyor roller 64. The conveyor roller 64 and the press roller 65, constituting a sheet conveyor section which is a printing medium conveyor section, conveys the sheet which is a printing medium. Furthermore, in the sheet conveying route 60, a printer section 66 is provided for printing on a sheet being fed. At the inlet of the printed sheet receiver 57, a sheet discharge roller 67 is provided. A press roller 68 being pressed against the sheet discharge roller 67 is rotatably supported on the free end side of the opening-closing cover 59.

The printer section 66 includes a platen 69 disposed inside of the sheet conveying route 60, a carriage 70 which reciprocably moves along the platen 69 in a direction orthogonal to the sheet conveying route 60, the above-described wire dot printer head 1 mounted on the carriage 70, and an ink ribbon cassette 71. The ink ribbon cassette 71 is removably mounted.

The carriage 70 is driven by a motor (not shown), moving reciprocally along the platen 69. With the reciprocation of the carriage 70 along the platen 69, the wire dot printer head 1 reciprocates in the main scanning direction. In the present embodiment, therefore, a head driving mechanism is realized by the carriage 70 and the motor. The wire dot printer 50 has a built-in drive control unit 72 which controls each part in the body case 51. The drive control unit 72 controls the driving of such devices as the printer section 66, the tractor 63, and the motor.

In the wire dot printer of such a configuration as described above, when cut sheets are used as the printing paper, the manual feed tray 54 is used to feed the sheets; and when a continuous paper is used, the paper is fed from the paper feed port 55. In either case, the paper is carried on the conveyor roller 64, and discharged by the sheet discharge roller 67 to the printed sheet receiver 57. In this process, printing is done by the wire dot printer head 1.

Printing is done as follows. In the wire dot printer head 1, when the coil 29 is selectively excited, the armature 4 is attracted to the pole face 28 of the core 27, rotating on the center of the support shaft 12 to thereby press the wire 10 against the sheet (not shown) on the platen 69 through an ink ribbon (not shown). When the current to the coil 29 is interrupted, the armature 4 is returned by the force of the pressing member 15, being stopped in the waiting position by the armature stopper 19.

To describe in detail, in printing by the wire dot printer 50, when the current is supplied selectively to the coil 29 in accordance with printing data by the control of the drive control unit 72, a magnetic circuit is formed from the core 27 fitted with the coil 29 thus selected, through the magnetic circuit forming member 11 of the armature 4 disposed oppositely to the core 27 and a pair of side yoke sections 33 disposed oppositely to the magnetic circuit forming member 11, and through between the cylindrical portion 21 on the outer periphery side and the cylindrical portion 22 on the inner periphery side of the yoke 6, and then from the bottom section 23 back to the core 27.

With the formation of the magnetic circuit, the force of attraction is produced between the face to be attracted 14 of the magnetic circuit forming member 11 and the pole face 28 of the core 27, for attracting the magnetic circuit forming member 11 to the pole face 28 of the core 27. The armature 4, therefore, is rocked on the center of the support shaft 12 in the direction in which the face to be attracted 14 of the magnetic circuit forming member 11 is attracted to the pole face 28 of the core 27. In the present embodiment, the printing position is the position where the face to be attracted 14 of the magnetic circuit forming member 11 of the armature 4 comes in contact with the pole face 28 of the core 27.

With the rocking of the armature 4 to the printing position, the front-end of the wire 10 protrudes to the sheet side. In the present embodiment, an ink ribbon (not shown) is interposed between the wire dot printer head 1 and the sheet. Therefore, the pressure of the wire 10 is transmitted to the sheet through the ink ribbon to transfer ink from the ink ribbon to the sheet, thereby performing printing.

When the current to the coil 29 is interrupted, the formation of the magnetic flux will cease, and accordingly the magnetic circuit also will cease. Since the magnetic circuit forming member 11 loses the attraction force for attraction to the pole face 28 of the core 27, the armature 4 is pressed by the pressing member 15 in a direction away from the yoke 6, rocking on the center of the support shaft 12 toward the waiting position. The armature 4 rocks toward the waiting position until the arm 9 comes in contact with the armature stopper 19, thus stopping in the waiting position.

The above-described printing operation is performed at a high speed (e.g., at a printing speed of 2500 times per second). At this time, the armature 4 rocks at a high speed of for instance 2500 times per second between the printing position and the waiting position. Since the plate-like receiving member 36 is in constant contact with the pressing member 15, being pressed by a contact pressure, the pressing member 15 can be restrained from impairing the arm 9 of the armature 4, thereby preventing the arm 9 from fracturing. Consequently, the life prolongation of the wire dot printer head 1 can be realized. Furthermore, the receiving member 36, being in contact with the whole contact face 37 of the pressing member 15, can receive the pressure of the pressing member 15 in balance. It is therefore possible to realize stabilized rocking operation of the armature 4.

Here, simply forming a thick arm 9 of the armature 4 can prevent to some extent the pressing member 15 from impairing the arm 9 of the armature 4. There, however, will arise such a problem that the moment of inertia of the rocking armature 4 will increase to impede high-speed printing operation. In the present embodiment, the moment of inertia (value of inertia) can be decreased to about 0.0034 $kgmm^2$ and therefore high-speed printing can be realized.

Figure 7:
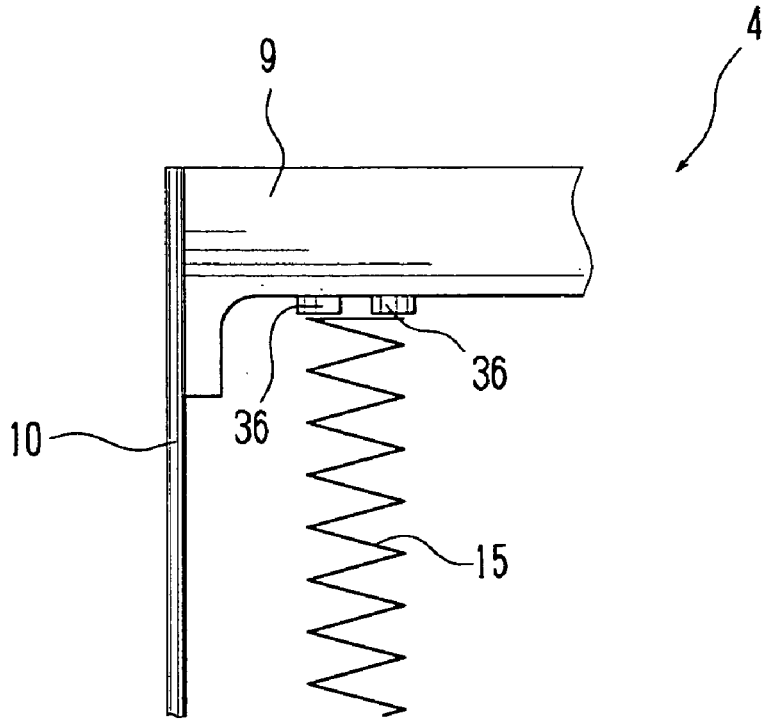
FIG. 7 is a side view schematically showing a part of a modification 1 of the armature according to the embodiments of the present invention.
Figure 8:
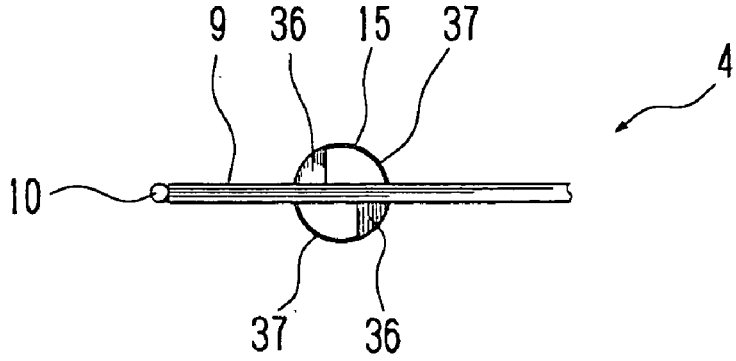
FIG. 8 is a plan view schematically showing a part of the modification 1 of the armature according to the embodiments of the present invention;.
Figure 9:
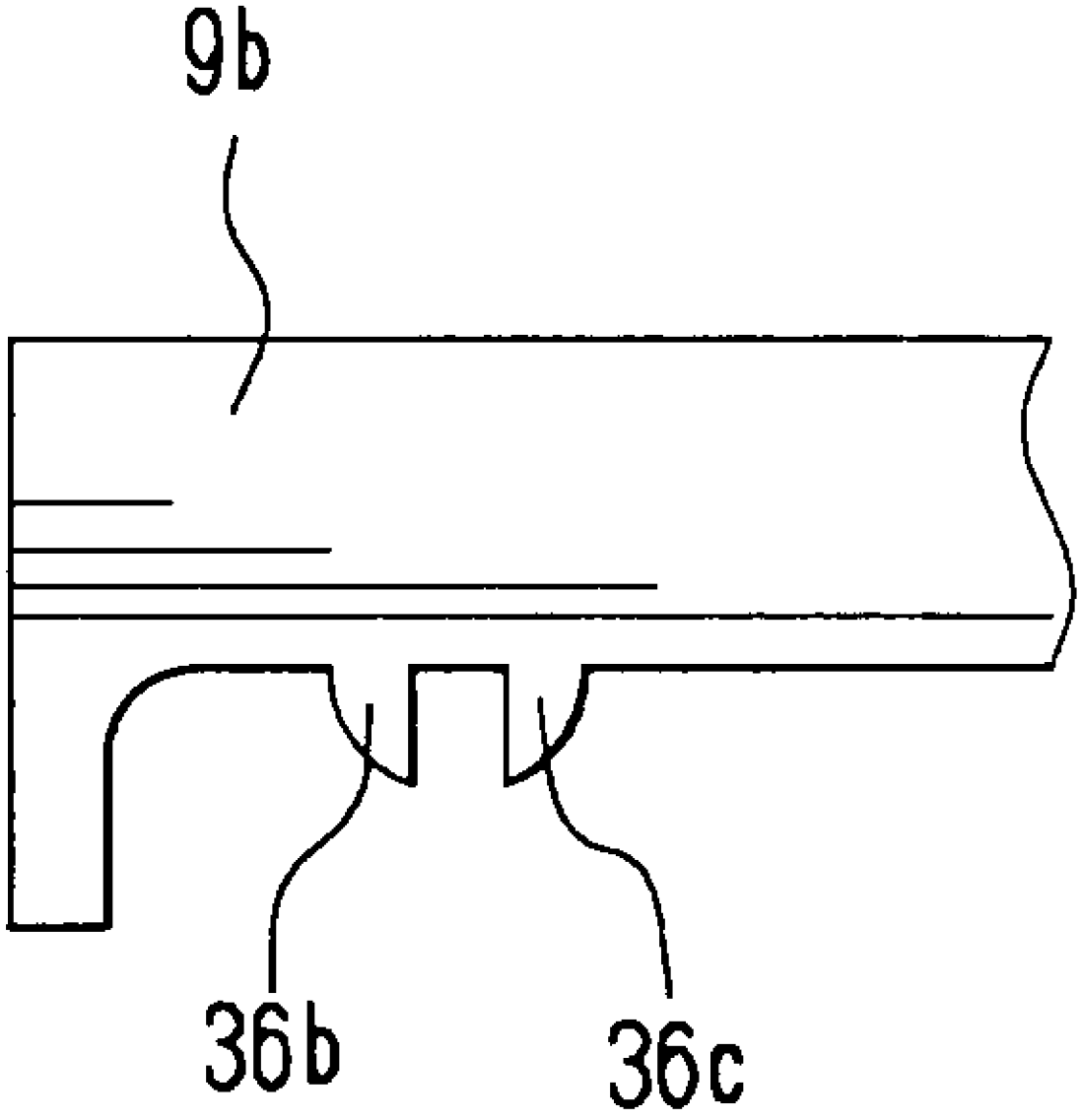
FIG. 9 is a side view for explaining a method of forming a part of the modification 1 of the armature according to the embodiments of the present invention.

Next, the modification 1 of the armature 4 will be explained by referring to FIGS. 7 to 9. FIG. 7 is a side view schematically showing a part of the modification 1 of the armature 4. FIG. 8 is a plan view schematically showing a part of the modification 1 of the armature 4. FIG. 9 is a side view for explaining a method of forming a part of the modification 1 of the armature 4.

In the modification 1 of the armature 4, the receiving member 36 is so formed as to be in contact only with a part of the contact face 37 of the pressing member 15. The receiving member 36 is mounted on both sides of the arm 9 of the armature 4. Either receiving member 36 is formed to cover, for instance, about one quarter of the contact face 37 of the pressing member 15. Thus it becomes possible, by the use of a simple structure, to prevent the pressing member 15 from giving damage to the arm 9 of the armature 4.

Furthermore, the receiving member 36 is formed unitarily with the arm 9 by bending one part 36*b*, 36*c* of the plate 9*b* which forms the arm 9 (see FIG. 9). The arm 9 and the receiving member 36 therefore can readily be formed unitarily of the plate 9*b*. The part 36*b* and the part 36*c* of the plate 9*b* are bent to opposite sides. Thus the receiving member 36 can receive the pressure of the pressing member 15 in balance, realizing the stabilized rocking of the armature 4. It is to be understood that only two receiving members 36 are provided, but the present invention is not to be limited thereto; four receiving members for instance may be provided.

Figure 10:
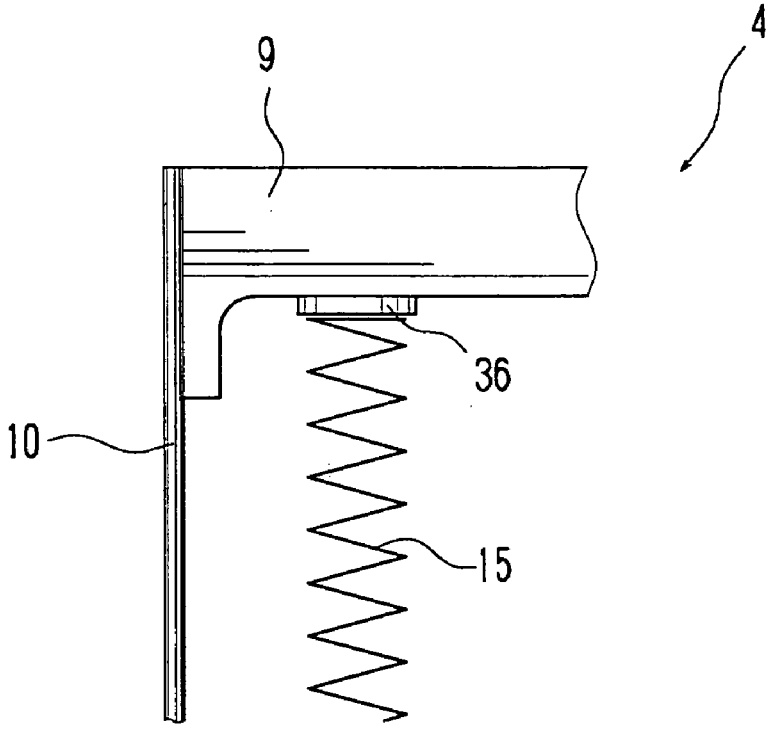
FIG. 10 is a side view schematically showing a part of a modification 2 of the armature according to the embodiments of the present invention.
Figure 11:
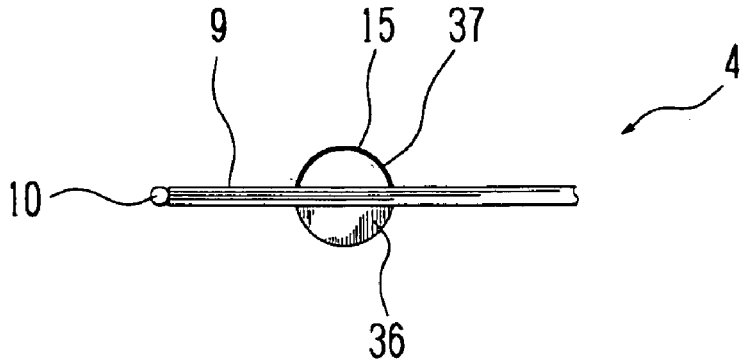
FIG. 11 is a plan view schematically showing a part of the modification 2 of the armature according to the embodiments of the present invention.
Figure 12:
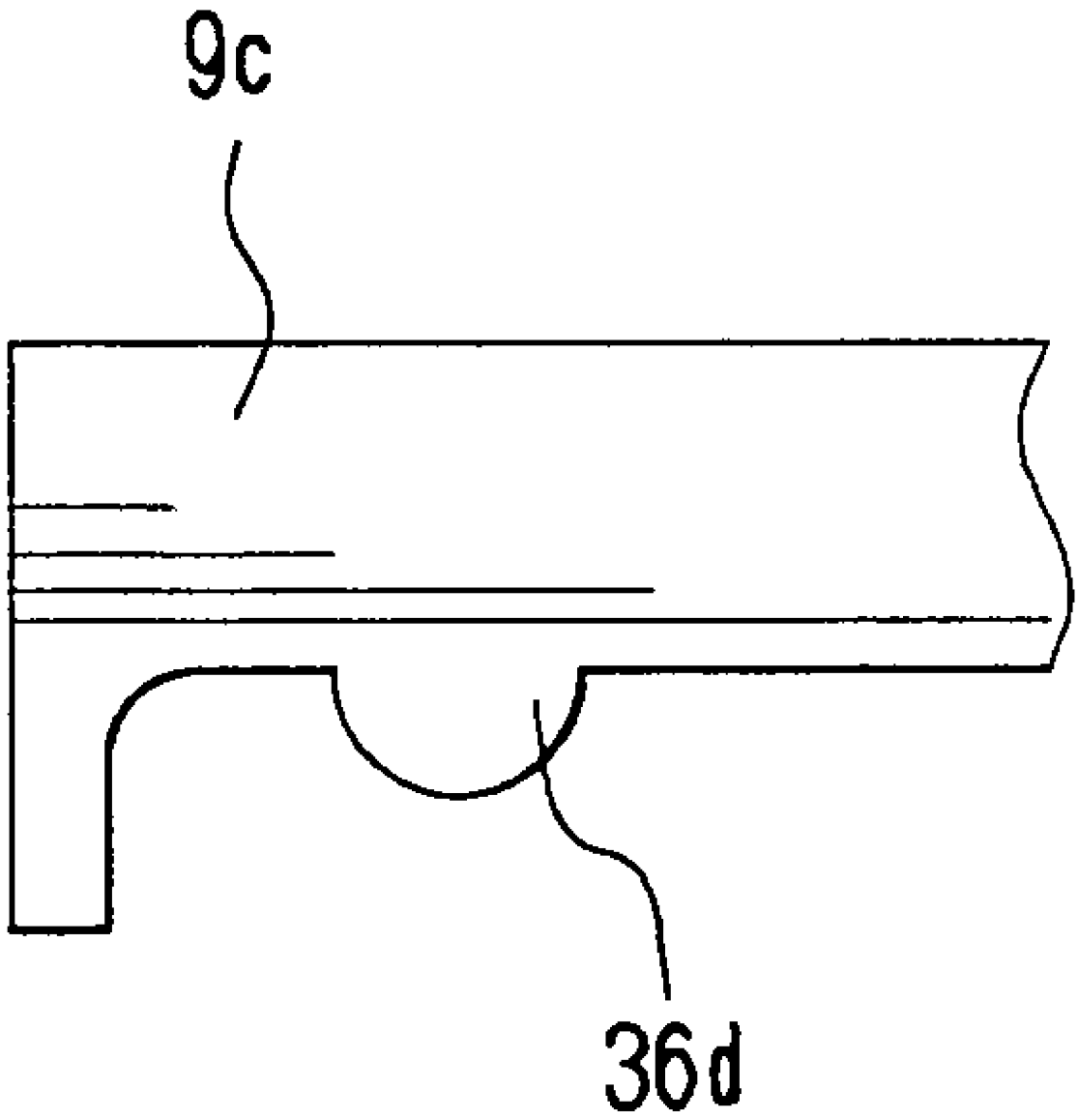
FIG. 12 is a side view for explaining a method of forming a part of the modification 2 of the armature according to the embodiments of the present invention.

Furthermore, the modification 2 of the armature 4 will be explained by referring to FIGS. 10 to 12. FIG. 10 is a side view schematically showing a part of the modification 2 of the armature 4. FIG. 11 is a plan view schematically showing a part of the modification 2 of the armature 4. And FIG. 12 is a side view for explaining a method of forming a part of the modification 2 of the armature 4.

In the modification 2 of the armature 4 also, the receiving member 36 is formed so as to be in contact only with one part of the contact face 37 of the pressing member 15. Then, the receiving member 36 is provided only on one side of the arm 9 of the armature 4. The receiving member 36 is formed to a shape, for instance to cover about a half of the contact face 37 of the pressing member 15, thereby enabling, by the use of a simple structure, preventing the pressing member 15 from giving damage to the arm 9 of the armature 4. Furthermore, the receiving member 36 is formed unitarily with the arm 9 by bending a part 36*d* of the plate 9*c* which forms the arm 9 (see FIG. 12). Therefore the arm 9 formed of the plate 9*c* and the receiving member 36 can easily be formed as one body.

It will be understood that, in the present embodiment, paper is used as the printing medium, but the present invention is not to be limited thereto; for example, a pressure-sensitive coloring paper which produces colors in a pressure-applied area when a pressure is applied, may be used. In the case of the pressure-sensitive coloring paper used as the printing medium, colors are produced in the area applied with a pressure of the wire 10 of the wire dot printer head 1, thereby carrying out printing operation.

In the present embodiment, the receiving member 36 is formed unitarily with the arm 9 of the armature 4. It is therefore possible to realize a high-strength, long-life wire dot printer head 1 as compared with a wire dot printer head having a receiving member formed separately from an armature arm.

Furthermore, in the present embodiment, the receiving member 36, formed by bending a part of the arm 9, can readily be formed.

Furthermore, in the present embodiment, the receiving member 36, disposed orthogonally to the direction of application of the pressure from the pressing member 15, can well receive the pressure from the pressing member 15, enabling the realization of stabilized rocking motion of the armature 4.

Furthermore, in the present embodiment, the end face of the arm 9 on the core 27 side in the armature 4 is formed smaller in width in a direction orthogonal to the direction of extension of the arm 9 than the pressing member 15.

Therefore, it is possible to reduce the weight of the armature 4 and to realize high-speed printing.

Furthermore, in the present embodiment, the pressing member 15 has a contact face 37 which is in contact with the receiving member 36. The receiving member 36 is so formed as to come in contact only with one part of the contact face 37 of the pressing member 15. It is therefore possible to prevent the pressing member 15 with such a simple structure from damaging the arm 9 of the armature 4.

Furthermore, in the modification 1 of the present embodiment, since the receiving member 36 is disposed, in a sandwiching manner, on both sides of the arm 9 of the armature 4, it is possible to reliably prevent the pressing member 15 with a simple structure from damaging the arm 9 of the armature 4.

Furthermore, in the modification 2 of the present embodiment, since the receiving member 36 is disposed on one side of the arm 9 of the armature 4, it is possible to reliably prevent the pressing member 15 with a simple structure from damaging the arm 9 of the armature 4.

Furthermore, in the present embodiment, the arm 9 is around 0.20 mm thick, to therefore reduce the weight of the armature 4, thereby realizing high-speed printing.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head comprising:

a plurality of cores each wound with a coil;

a plurality of armatures each having an arm supporting a printing wires, and rockably mounted in a position opposite to the plural cores;

a plurality of receiving members each formed in a share of a plate, and each mounted on an end face on a core side of the arm; and a plurality of pressing members each being in contact with the plurality of receiving members, and pressing the armatures in a direction away from the cores, wherein the pressing member has a contact face for being in contact with the receiving member, the receiving member being formed to come in contact only with one part of the contact face of the pressing member.

2. A wire dot printer head according to claim 1, wherein the receiving member is unitarily formed with the arm.

3. A wire dot printer comprising:

a wire dot printer head according to claim 2;

a platen disposed oppositely to the wire dot printer head;

a carriage which reciprocates along the platen2 holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

4. A wire dot head according to claim 2, wherein the receiving member comprises a part of the arm.

5. A wire dot printer comprising:

a wire dot printer head according to claim 4;

a platen disposed oppositely to the wire dot printer head;

a carriage which reciprocates along the platen, holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

6. A wire dot printer head according to claim 1, wherein the receiving member is disposed orthogonally to the direction of pressure application by the pressing member.

7. A wire dot printer comprising:

a wire dot printer head according to claim 6;

a platen disposed oppositely to the wire dot printer head;

a carriage which reciprocates along the platen, holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

8. A wire dot printer head according to claim 1, wherein an end face on the core side of the arm is formed smaller in width in a direction orthogonal to the direction of extension of the arm than the pressing member in the direction of width.

9. A wire dot printer comprising:

a wire dot printer head according to claim 8;

a platen disposed oppositely to the wire dot printer head;

a carriage which reciprocates along the platen, holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

10. A wire dot printer head according to claim 1, wherein the receiving member is provided on both sides of the arm.

11. A wire dot printer comprising:

a wire dot printer head according to claim 10;

a platen disposed oppositely to the wire dot printer head;

a carriage which reciprocates along the platen, holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

12. A wire dot printer head according to claim 1, wherein the receiving member is provided on one side of the arm.

13. A wire dot printer comprising:

a wire dot printer head according to claim 12;

a platen disposed oppositely to the wire dot printer head;

a carriage which reciprocates along the platen, holding the wire clot printer head;

a printing medium conveyor section which conveys a printing medium between the wire dot printer head and the platen; and a drive control unit which drives the wire dot printer head, the carriage, and the printing medium conveyor section in accordance with printing data.

14. A wire dot printer head according to claim 1, wherein the arm is about 0.20 mm thick.

15. A wire dot printer comprising:

a wire dot printer head according to claim 14;

a platen disposed oppositely to the wire dot printer head;

a carriage which reciprocates along the platen, holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

16. A wire dot printer comprising:

a wire dot printer head according to claim 1;

a platen disposed oppositely to the wire dot printer head;

a carriage which reciprocates along the platen, holding the wire dot printer head;

a printing medium conveyor section which conveys a printing medium between the wire dot printer head and the platen; and a drive control unit which drives the wire dot printer head, the carriage, and the printing medium conveyor section in accordance with printing data.

* * * * *